United States Patent [19]

Garner et al.

[11] Patent Number: 4,747,726

[45] Date of Patent: May 31, 1988

[54] CONCRETE SCREEDING MACHINE

[76] Inventors: James D. Garner, 126 Kings Chapel Rd.; John M. Hinnant, 3973 Belair Rd., both of Augusta, Ga. 30907

[21] Appl. No.: 947,513

[22] Filed: Dec. 29, 1986

[51] Int. Cl.[4] ..... E01C 19/29

[52] U.S. Cl. ..... 404/123; 404/125

[58] Field of Search ..... 404/103, 106, 119, 120, 404/122, 123, 125

[56] References Cited

U.S. PATENT DOCUMENTS

| | | | |
|---|---|---|---|
| 1,017,430 | 2/1912 | Lilleberg | 404/123 |
| 1,584,385 | 5/1926 | Lichtenberg | 404/119 |
| 2,048,071 | 7/1936 | Jacobsen | 404/106 X |
| 2,426,702 | 9/1947 | Milliken et al. | 94/45 |
| 2,687,679 | 8/1954 | Clary | 404/123 |
| 3,377,933 | 4/1968 | Dale | 94/45 |
| 4,115,976 | 9/1978 | Rohrer | 52/741 |

*Primary Examiner*—James A. Leppink
*Assistant Examiner*—Matthew Smith
*Attorney, Agent, or Firm*—Thomas & Kennedy

[57] ABSTRACT

A screeding machine has hydraulic cylinders for independently raising and lowering the opposite ends of a drive roller to effect steering actions.

3 Claims, 2 Drawing Sheets

CONCRETE SCREEDING MACHINE

TECHNICAL FIELD

This invention relates to machines for screeding materials such as concrete and cement used in the process of paving roads and the like.

BACKGROUND OF THE INVENTION

Machines have heretofore been developed for screeding paving material such as concrete and cement. Exemplary of such machines are those disclosed in U.S. Pat. Nos. 1,584,385, 2,426,702, 3,377,933 and 4,115,976. The machines today often comprise a frame that is supported by two or more drive rollers that are adapted to be driven along and atop a pair of forms that straddle a surface area to be paved which also serves as track rails for the machines. The machines have also included a screed roller at their front ends which are elevated slightly above the drive rollers and the forms. The screed rollers are driven in a reverse direction to that of the support rollers so that as the machines advance upon paving material, that has been dumped and piled between the forms, they fling and spread the material forwardly of the machine in flattening and leveling the piles of material. As the machines continue to advance, their drive rollers further smooth out the material since they are positioned slightly lower than the screed rollers.

Though the just described screeding machines have worked satisfactorily in many aspects, there has been one persistent problem attendant with their use. Specifically, these machines have been difficult to steer in an efficient manner upon the rails provided by the material confining forms. As their drive rollers must be quite wide in order to span the entire width of roadway surfaces to be paved, a slight skewing of the rollers with respect to the parallel forms causes the screeding machines, as a whole, to assume an angle of attacks with respect to the forms. As a result continued movement along such a skewed path established by an angle of attack will cause the machine to drop off of one of the forms and into the roadway bed if its forward movement is not quickly arrested. To prevent such from occurring it has typically been necessary to stop the screeding machine and then rotate it back to a proper position with its drive rollers reoriented right-angularly to the forms. Of course, where the roadway itself makes a curve, such inclemental advancements, stoppages and turnings of the machine must be done repeatedly until the roadway completes the curve and reassumes a linear direction.

This just described steering process has naturally limited the operational efficiency of these types of screeding machines. This problem may be avoided by other types of screeding machines, such as those driven with endless treads that are independently powered. This, however, is a much more costly type machine. Those driven with flanged wheels guided on the rails, such as that shown in the aforementioned U.S. Pat. No. 3,377,933, also do not have this specific problem. These, however, have other restrictions such as, for example, the need for adjustment for use in paving roads of diverse widths.

Accordingly, it is a general object of the present invention to provide a concrete screeding machine of the type that employs elongated drive rollers with enhanced steering capabilities. It is to the provision of such a machine therefore that the present invention is primarily directed.

SUMMARY OF THE INVENTION

In one form of the invention a concrete screeding machine comprises a frame to which a pair of drive rollers is mounted for rotation in one rotary direction about parallel axes tangentially to a reference support plane. Motor means are provided for driving at least one of the drive rollers in the one rotary direction. Means are provided for selectively raising opposite ends of the one drive roller above the reference support plane in steering the machine. A screed roller is rotatably mounted to a forward portion of the frame for rotation so as to pass above the reference support plane. The machine further includes means for driving the screed roller in a rotary direction opposite to the one rotary direction.

In another form of the invention a concrete screeding machine comprises a frame to a rear portion of which a rear drive roller is rotatably mounted. A forward drive roller is rotatably mounted to the frame forwardly of the rear drive roller. A screed roller is rotatably mounted to a front end of the frame forwardly of the forward drive roller. The machine further comprises motor means for driving at least one of the drive rollers in one rotary direction and for driving the screed roller in a rotary direction counter to the one rotary direction. The machine further comprises steering means that includes means for selectively raising and lowering opposite ends of the forward drive roller.

DETAILED DESCRIPTION

Figure 1:
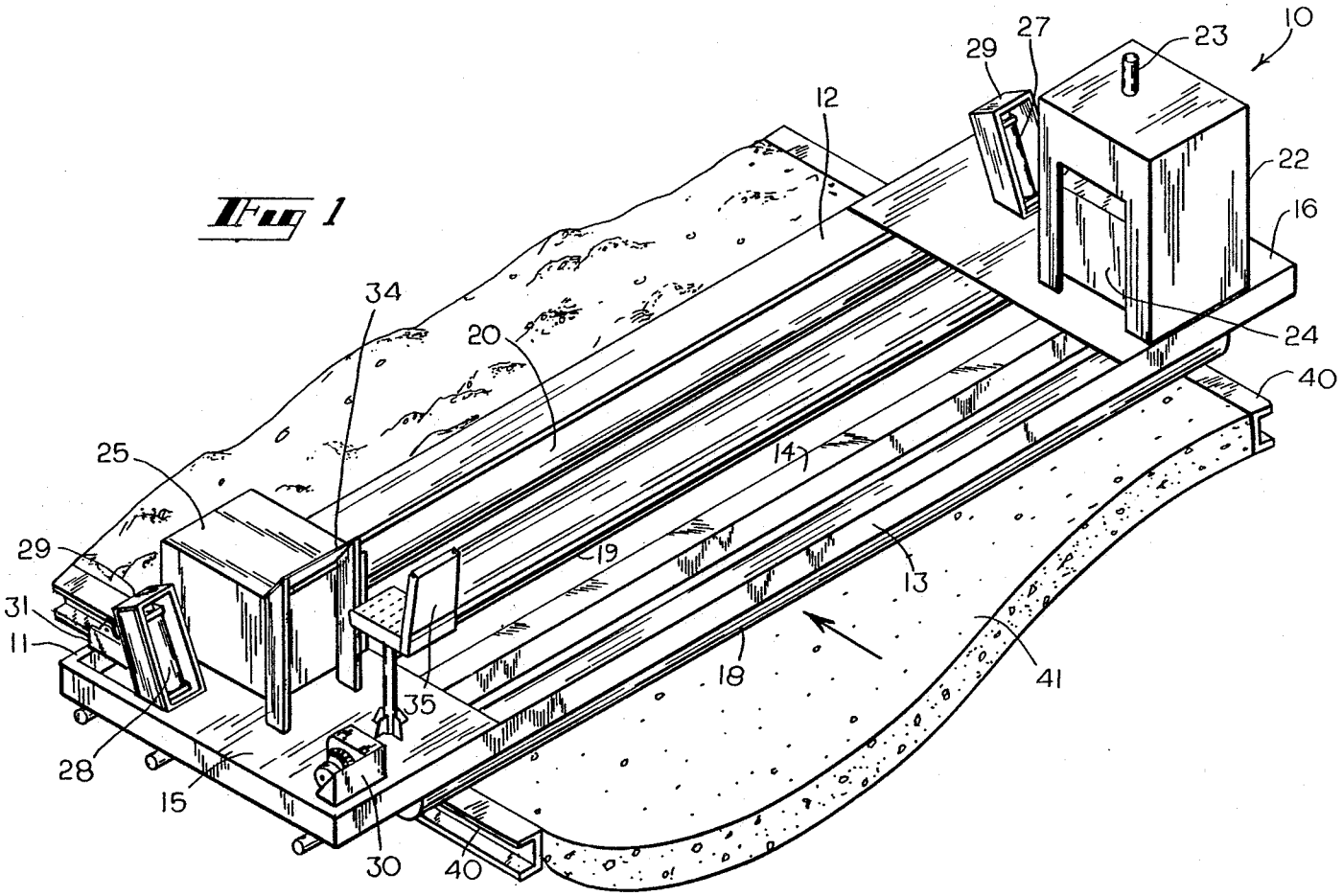
FIG. 1 is a perspective view of a concrete screeding machine that embodies principles of the invention which is shown in the process of finishing a concrete surface of a road being paved.

With reference next to the drawing, there is shown a screeding machine, indicated generally at 10, which has a frame that includes a front beam 11 overlaid by a walkway 12, a rear beam 13, and an intermediate beam 14 all of which span the space between and provide support for two side platforms 15 and 16. To the frame are rotatably mounted a rear drive roller 18 and a forward driver roller 19. A screed roller 20 is also rotatably mounted to the frame forwardly of the forward drive roller 19.

The screeding machine is provided with a hydraulic power system that includes a diesel engine within an engine housing 22 from which a stack 23 extends, and a master pump mounted within a pump housing 24 atop the platform 16. The hydraulic system includes an hydraulic oil reservoir 25 which is mounted upon the other platform 15. The loads powered by the hydraulic power system include a right side hydraulic lift cylinder 27 and a left side hydraulic lift cylinder 28 each of which is mounted within a protective housing 29. The system loads also include an hydraulic motor 30 mounted to a rear portion of the platform 15 for driving the drive roller, and an hydraulic motor 31 mounted to a forward portion of the platform 15 for driving the screed roller. The hydraulic system is of conventional construction and thus its hydraulic lines and controls have not been shown, for clarity of illustration. These hydraulic lines extend between the several elements of the system with those extending between system components mounted on the two platforms 15 and 16 passing through the beam 14. The system is controlled from a control panel 34 which is positioned behind the reservoir 25 in front of a chair 35 upon which an operator may sit while operating the machine.

The rear drive roller 18 and the forward drive roller 19 are driven synchronously by power takeoff from the hydraulic motor 30. This power takeoff includes a drive chain 37 that is routed downwardly from the motor through an opening in the platform 15 and about a sprocket mounted to a portion of the axle 18' that extends outwardly from an end of the roller itself. The axle 18' is in turn coupled with the axle 19' of the forward drive roller 19 by a unshown chain that is routed over sprockets mounted to the two axles. Thus, by operation of the hydraulic motor 30 the drive rollers 18 and 19 can be rotated in the counterclockwise direction indicated by the arrows shown adjacent to them in FIG. 2 in advancing the machine.

Figure 2:
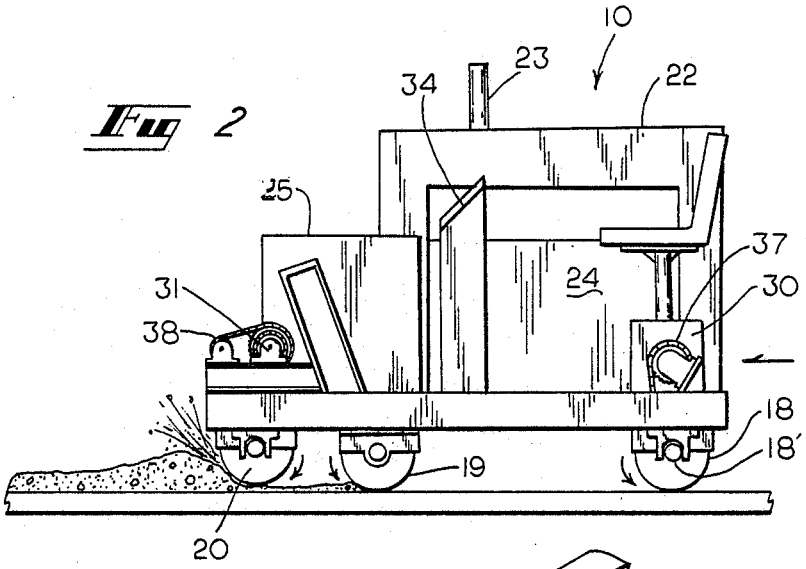
FIG. 2 is a side elevational view of the machine illustrated in FIG. 1 also shown in the process of screeding concrete.

The screed roller 20 is driven by the motor 31 with power transmitted from the motor to it by an endless chain 38 that is partially shown in FIG. 2. This chain is also routed over a sprocket mounted to the axle of the screed roller so as to drive the screed roller in the clockwise direction indicated by the arrow shown adjacent to it in FIG. 2. The screed roller is mounted at a height such that it is elevated slightly above the drive rollers 18 and 19 so that it rotates slightly above an imaginary reference support plane extending tangentially to the lowermost points of travel to the two drive rollers. This plane also extends across the tops of the two C-channel shaped forms 40 that straddle the roadway being paved.

Figure 3:
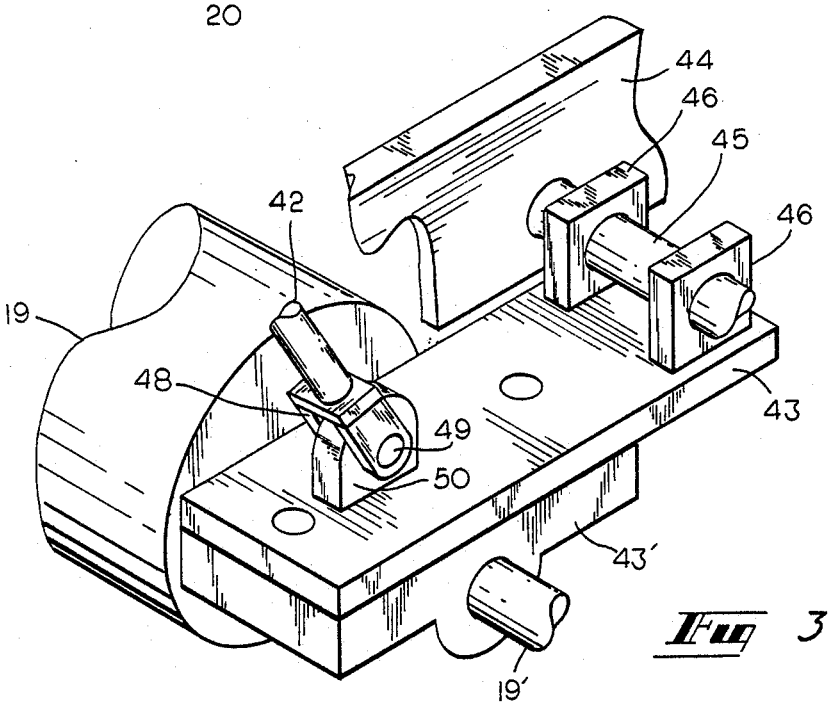
FIG. 3 is a perspective view of a portion of the steering mechanism of the machine illustrated in FIG. 1.

The concrete screeding machine also includes a steering mechanism for steering the machine as it advances upon the forms 40 in leveling and finishing the concrete surface of a roadway being paved between the two forms. As best shown in FIG. 3, the steering mechanism includes the two lift cylinders 27 and 28 shown in FIG. 1. Each of these has its actuation rod 42 operatively coupled with one of two hinge plates 43. Each hinge plate is mounted to a frame section 44 by a pivot pin 45 which is journalled through two pillow blocks 46 rigidly mounted atop the hinge plate. The cylinder rod 42 has its end rigidly joined to a fork 48 that is pivoted by a pivot pin 49 to another pillow block 50 mounted atop the hinge plate. As one of each assemblage shown in FIG. 3 is mounted to opposite ends of the forward drive roller 19, specifically by having its axle 19' journalled through a bearing formed in a lower portion 43' of the hinge plate, either of the hydraulic cylinders may be used to alter the elevation of one end of the forward drive roller with respect to the frame. Since the roller is normally rolling upon one of the forms 40 that border the roadway being paved, the operation of the cylinder normally will cause one end of the drive roller 19 to be elevated with respect to its other end and the frame, which action momentarily causes the machine to turn. Exactly why this occurs is not fully understood since the two driver rollers remain located along parallel vertical planes and remain in 4-point contact with parallel rails. Apparently, the momentary change in load on one end of one roller effected by movement of a lift cylinder, and the slight off-plane skewing of the rollers produces this steering effect. Upon actuation of a cylinder a slight turning has been observed both during cylinder actuation as well as so long as one end remains elevated.

In operation the machine may be advanced upon irregular piles of concrete shown in front of the machine in FIG. 1 whereupon the screeding machine effects a screeding action as also shown in FIG. 2. There it will be seen that the screeding roller is flinging and spreading out concrete paving material in advance of its progress leaving only a small ribbon of material trailing the screed roller in advance of the forward drive roller 19. Passage of the drive rollers over this ribbon causes the surface to be finished into a substantially flat configuration. As this screeding action occurs the machine may be properly steered by an operator sitting upon the seat 35 by the use of controls that independently actuate the two lift cylinders 27 and 28. For example, should the operator desire the machine to turn slightly to the right, as viewed in FIG. 1, the lift cylinder 28 will be actuated to raise the right side of the roller 19, until a new desired direction of advance is obtained, and then lowered to its original position.

It thus is now seen that a concrete screeding machine is provided which has decidedly demonstrated improved steering capabilities and efficiencies. It should be understood that the just described embodiment merely illustrates principles of the invention in one preferred form. Many modifications, additions and deletions may, of course, be made thereto without departure from the spirit and scope of the invention as set forth in the following claims.

We claim:

1. A concrete screeding machine comprising a frame; a pair of rollers mounted to said frame for rotation in one rotary direction about parallel axes passing to a reference support plane tangential to said rollers, motor means supported on said frame for driving at least one of said rollers in said one rotary direction; means for selectively lifting opposite ends of said one roller momentarily above said reference support plane in steering the machine that comprises a pair of hydraulic cylinders mounted to opposite sides of said frame and a pair of hinge plates each pivotably mounted at one point to said frame for pivotable movement about a common axis oriented substantially parallel to said one drive roller to each of which plates one of said hydraulic cylinders is operatively connected and to which plates opposite ends of said one roller are journalled; a screed roller mounted to a forward portion of said frame for rotation passing above said reference support plane; and means for driving said screed roller in a rotary direction opposite to said one rotary direction.

2. The screeding machine of claim 1 wherein each of said hinge plates is pivotally mounted to said frame for pivotal movement about a pivot axis oriented substantially parallel to said parallel axes.

3. A concrete screeding machine comprising a frame; a rear drive roller rotatably mounted to a rear portion of said frame; a forward drive roller rotatably mounted to said frame forwardly of said rear roller; a screed roller rotatably mounted to a front end of said frame forwardly of said forward drive roller; motor means supported on said frame for driving at least one of said drive rollers in one rotary direction and for driving said screed roller in a rotary direction counter to said one rotary directon; and steering means that includes means for selectively raising and lowering opposite ends of said forward drive roller that includes a pair of roller supports each pivoted at one point to said frame and hydraulic cylinder means coupled with said roller supports for independently pivoting each of said roller supports about an axis oriented substantially parallel to said forward drive roller.

* * * * *